United States Patent [19]

Hills

[11] 4,182,324

[45] Jan. 8, 1980

[54] DIVER GAS SAFETY VALVE

[76] Inventor: Brian A. Hills, 200 University Blvd., Galveston, Tex. 77550

[21] Appl. No.: 829,643

[22] Filed: Sep. 1, 1977

[51] Int. Cl.[2] ..... B63C 11/14

[52] U.S. Cl. ..... 128/201.27; 128/276; 137/508

[58] Field of Search ..... 128/142.3, 142.2, 276, 128/297, 142 R, 142.7; 137/853, 860, 508, 510, 493

[56] References Cited

U.S. PATENT DOCUMENTS

| | | | |
|---|---|---|---|
| 3,298,391 | 1/1967 | Savage | 137/493 |
| 3,353,560 | 11/1967 | McCulloch | 137/853 X |
| 3,968,794 | 7/1976 | O'Neill | 128/142.3 |
| 4,080,964 | 3/1978 | Savoie, Jr. | 128/142.3 |
| 4,137,912 | 2/1979 | O'Neill | 128/142.3 |

FOREIGN PATENT DOCUMENTS

| | | |
|---|---|---|
| 917423 | 8/1959 | United Kingdom . |
| 1206721 | 9/1970 | United Kingdom . |
| 1300348 | 12/1972 | United Kingdom . |
| 1321566 | 6/1973 | United Kingdom . |
| 1329650 | 9/1973 | United Kingdom . |

*Primary Examiner*—Henry J. Recla

*Attorney, Agent, or Firm*—Pravel, Gambrell, Hewitt, Kirk, Kimball & Dodge

[57] ABSTRACT

For use in helium or other gas reclamation, a diver gas safety valve adapted for attachment to a diver's helmet and to an exhaust gas recovery system, the safety valve including a collapsible tube for expanding to transfer exhaust gas having a pressure greater than ambient water pressure surrounding the diver and for collapsing to prevent such exhaust gas transfer at exhaust gas pressure below the ambient water pressure in order to prevent dangerous, sudden outflows of the exhaust gas from the diver's helmet.

6 Claims, 3 Drawing Figures

E
R
V
2
2
D
H
B
11
21
11a
R
16
14b
14
14a
23
14c
18
14d
11b
25a
25
25b
V
11e
10
11d
11c
21
11
20
11a
17
12d
22
12c
12
12a
30
12b
15

DIVER GAS SAFETY VALVE

BACKGROUND OF THE INVENTION

The field of this invention is safety apparatus for underwater divers for use in helium or other gas reclamation, and in particular, safety apparatus preventing a dangerous outflow of exhaust gas from the diver's helmet or other such habitat.

In recent years, the level of offshore oil and gas exploration and production has substantially increased the necessity of diver utilization at significant water depths, such as 150 feet and below, to install and repair equipment. It has been a common practice to utilize a diver breathing gas mixture consisting essentially of nitrogen and oxygen; but, at deeper depths, such as 150 feet and below, the utilization of nitrogen in the breathing mixture creates the most serious problem of nitrogen narcosis caused by the absorption of nitrogen into the body. Nitrogen narcosis is best avoided by reducing nitrogen in the breathing mixture. Helium has been found to be a desirable inert gas for use in a helium-oxygen breathing mixture which is readily usable by divers at such significant depths without the tremendously high probability of dangerous absorption into the body. However, helium is a rare gas and is thus very expensive by comparison to nitrogen.

When using nitrogen-oxygen breathing mixtures, it is the practice to exhaust helmet gas directly into the water surrounding the diver. However, when helium is used in a helium-oxygen mixture, it has been found desirable to recover the exhausted gas for recycling in order to reclaim the helium for further use. Helium recovery systems, such as disclosed in U.S. Pats. Nos. 3,924,616 and 3,370,585, recycle diver exhaust gas for reuse by essentially removing carbon dioxide from the exhaust gas and adding oxygen thereto while preserving the supply of helium. Such diver gas recovery systems are located either on the water surface or at a diving bell or habitat located below the water, but generally above the locus of diver activity. In diver gas recovery systems, a diver gas supply line and an exhaust gas recovery line extend from the recovery system to the diver. The pressure of the breathing gas supply flowing into the diver's helmet is equal to or slightly above the pressure of the water surrounding the diver, this is termed herein "ambient water pressure." Therefore, the pressure of the exhaust gas leaving the diver's helmet and flowing into the exhaust gas line is slightly greater than ambient water pressure or essentially equal to it. However, the pressure at the other end of the exhaust gas return line attached to the helium recovery system, such as at the water surface, is at a substantially lower pressure than the pressure of gas leaving the diver's helmet. This pressure differential between the diver's helmet and the helium recovery system may cause a dangerously fast outflow of gas from the diver's helmet and thus decompression of the helmet, which may kill the diver.

It is presently known in the art to utilize various types of mechanical valve arrangements located in the exhaust gas return line to control the flow of the exhaust gas from the diver's helmet to the diver gas recovery system. For example, U.S. Pat. No. 3,924,616 discloses a combination of a safety shut-off valve and a back-pressure regulator valve mounted in the exhaust gas return line to maintain a desired pressure within the diver's helmet. U.S. Pat. No. 3,968,795 discloses the location in series of a normally open fail-safe valve and an exhaust control valve for maintaining helmet pressure within predetermined limits relative to ambient water pressure. Should the exhaust control valve fail in the device disclosed in U.S. Pat. No. 3,968,795, the fail-safe valve is designed to close to cut off any exhaust flow and thus prevent pressure within the helmet falling to a dangerously low level. U.S. Pat. Nos. 3,802,427 and 3,370,585 also disclose subject matter relating to the control of breathing and/or diver gas recovery systems. U.S. Pat. No. 3,467,094 relates to a bladder-type of control device for preventing oxygen dumping in a decompression chamber.

SUMMARY OF THE INVENTION

The diver gas safety valve of this invention is adapted for attachment to a diver's helmet and to an exhaust recovery system for transferring exhaust gas from the helmet to the exhaust gas recovery system safely and efficiently. The diver gas safety valve of this invention includes pressure safety means adapted for attachment to the diver's helmet and to the exhaust gas recovery system for expanding to transfer exhaust gas having pressure greater than ambient water pressure surrounding the diver and for collapsing to prevent exhaust gas transfer between the helmet and the exhaust gas recovery system at pressures below the ambient water pressure thereby preventing any dangerous outflow of exhaust gas from the diver's helmet.

The pressure safety means includes a hollow, collapsible tubular element having a hollow interior portion and an exterior which is exposed to the ambient water pressure for expansion and collapse in response to variation in the pressure of exhaust gas leaving the diver's helmet.

These features and other features of this invention will be described in more detail in the description to follow. It should be understood that this Summary does not represent all of the features of this invention and that only the claims define the scope of protection sought herein.

DESCRIPTION OF THE PREFERRED EMBODIMENT

Figures 1, 2, 3:
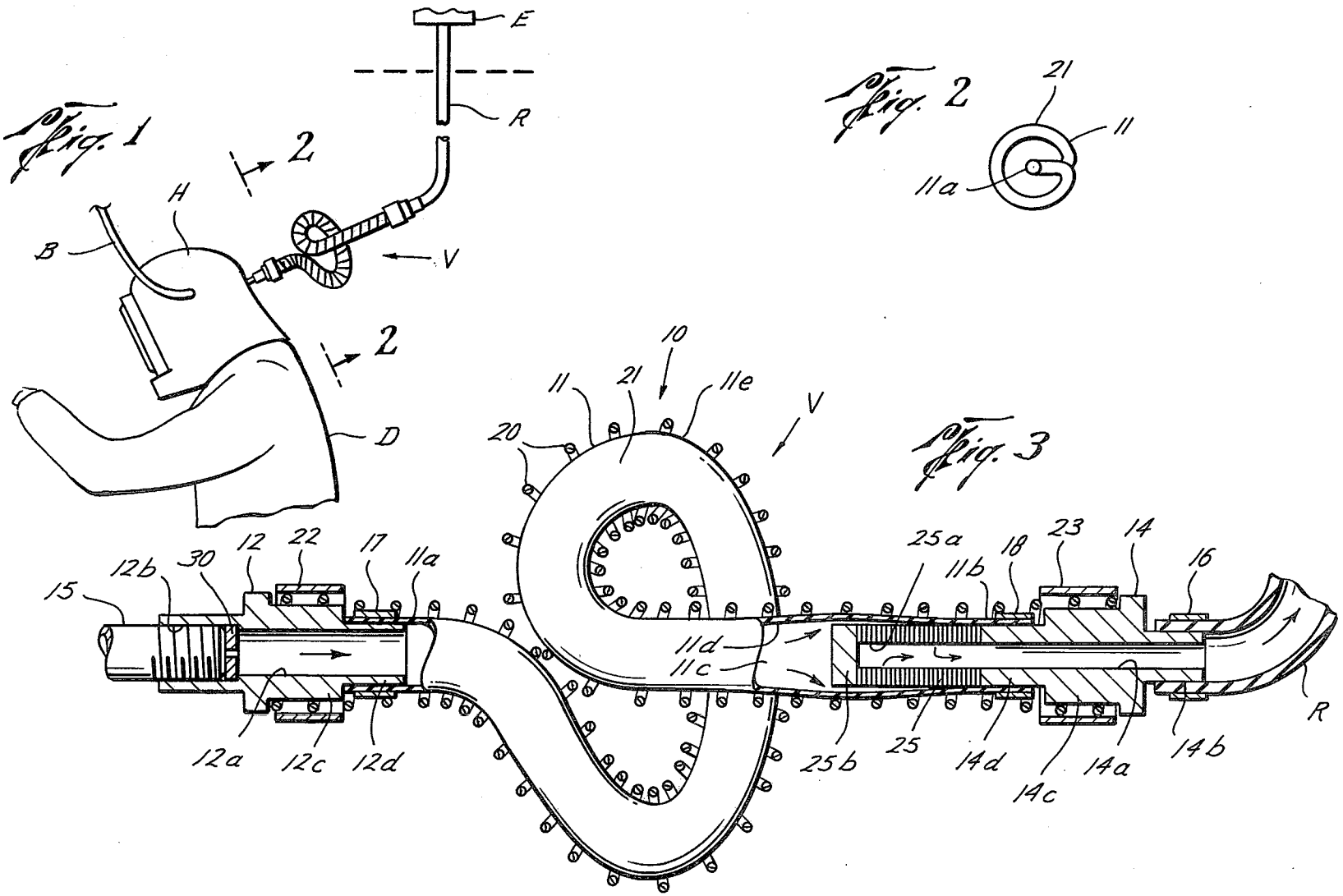
FIG. 1 is a partly schematic view of the diver gas safety valve of this invention attached to a diver's helmet and to a diver gas recovery system located at the water surface.
FIG. 2 is a sectional view taken along line 2—2 of FIG. 1 illustrating the coiled portion of the collapsible tubular element of the diver gas safety valve of this invention; and, FIG. 3 is a side view, partly in section, of the details of the diver gas safety valve.

Referring to the drawings, the letter V generally designates the diver gas safety valve of the preferred embodiment of this invention. The diver gas safety valve V is adapted for attachment to a helmet H of diver D and to the return line R of exhaust gas recovery system E, which is illustrated as being positioned at the surface of a body of water.

The diver's helmet H may be any suitable variety capable of containing breathable gas at pressures greater than water pressure at the depth of the diver, termed herein "ambient water pressure." For example, the helmet H may be similar to any of the helmets illustrated in the following patents: U.S. Pat. Nos. 3,968,795; 3,924,616; 3,802,427; and 3,370,585.

The exhaust gas recovery system E may be located at the water surface, such as illustrated in FIG. 1, or the system E or may actually be located underwater, itself. The exhaust gas recovery system E is provided to treat and recycle exhaust gas received from the diver for re-delivery back to the diver through breathing supply line B. Examples of such exhaust gas recovery systems, which by recycling serve to prevent waste of valuable helium, are illustrated in U.S. Pat. Nos. 3,924,616; 3,802,427; and 3,370,585. The return line R extends from the exhaust gas recovery system E to the diver gas safety valve V. The return line R is a flexible line which is sufficiently rigid to resist collapsing under the water pressure of the environment, which of course increases with depth.

The diver gas safety valve V includes pressure safety means generally designated by the number 10 adapted for attachment to the diver's helmet H and to the exhaust gas recovery system E for expanding to transfer exhaust gas having pressure at equal to or greater than ambient water pressure surrounding the diver and for collapsing to prevent exhaust gas transfer between the helmet H and exhaust gas recovery system E at pressures below ambient water pressure thereby preventing any dangerous outflow of exhaust gas from the diver's helmet. The pressure safety means 10 includes a hollow collapsible tubular element 11 attached to first and second adapters 12 and 14, respectively. The first and second adapters 12 and 14 cooperate to provide attachment means for attaching the diver gas safety valve V to the helmet H and to the return line R for the exhaust gas recovery system E.

The adapter 12 is a generally cylindrical adapter element having bore 12*a* therethrough. An enlarged bore portion 12*b* mounts a tube 15 which is attached to the diver's helmet H. The adapter 12 includes a central, outer cylindrical portion 12*c* and a cylindrical end portion 12*d* of reduced diameter with respect to the central portion 12*c*.

The adapter 14 is also generally cylindrical in configuration and includes a central bore 14*a* which extends therethrough. The adapter 14 terminates in an outer end portion 14*b* of reduced diameter with respect to central portion 14*c*. The reduced diameter end portion 14*b* receives the end of the return line R, which is fastened over the adapter end portion 14*b* by a suitable clamp 16. The adapter 14 further includes reduced diameter end portion 14*d* which is formed integrally with the central portion 14*c*.

The adapter end portion 12*d* is adapted to receive one end 11*a* of the collapsible tubular element 11, which is held in place by a suitable clamp 17. Similarly, the other end 11*b* of the collapsible tubular element is mounted over adapter end portion 14*d* and is held in place by a suitable clamp 18.

The collapsible tubular element 11 is a flexible, elongated tube which is hollow and thus includes an interior bore or passageway 11*c*, which is formed by interior, cylindrical wall portion 11*d*. The tubular element further includes the cylindrical exterior wall portion 11*e*. The material which forms the wall defined by interior wall 11*d* and exterior wall 11*e* is a flexible material which may be collapsed and expanded in response to relative pressure changes within tubular element 11*c* and the ambient water pressure.

A protective wire casing 20 is mounted about the collapsible tubular element 11 to protect the collapsible tubular element 11 from damage and to hold the collapsible tubular element in the coiled configuration illustrated in the drawings. Thus, the protective wire casing 20 forms the collapsible tubular element into a central, coiled portion 21 which joins the tubular element end portions 11*a* and 11*b*, which are in at least approximate axial alignment with each other. The protective wire casing 20 is mounted about the collapsible tubular element 11 and terminates in connection to adapter central portions 12*c* and 14*c*. The end portions of the protective wire casing 20 are held in place upon adapter portions 12*c* and 14*c* by clamps 22 and 23, respectively. The protective wire casing 20 offers the advantages of protecting the collapsible tubular element 11 from exterior damage; maintaining the central coiled portion 21 in such coiled configuration; and, exposing the collapsible tubular element to ambient water pressure. Other forms of protective casing 20 may also be utilized, so long as such casing designs provide these necessary functions.

A porous sleeve or insert 25 is adapted for attachment by any suitable means to adapter end portion 14*d*. The porous sleeve 25 may be a separate piece or may be formed integrally with the adapter 14. The porous sleeve 25 includes a central bore portion 25*a* which is positioned in alignment with adapter bore portion 14*a*. The porous sleeve 25 terminates in closed end portion 25*b*. The porosity of the sleeve 25 may be provided by a plurality of openings which may be formed in the material during manufacture or may be inherent in the type of material utilized. In either event, the purpose of such porosity is to allow for the transfer of exhaust gas from passageway 11*c* for tubular element 11 surrounding the porous sleeve 25 into the interior bore portion 25*a* thereof.

In order to provide the diver D with breathable gas, it is well-known that it is necessary to provide gas to the diver's helmet at a pressure which is slightly greater than the ambient water pressure at the depth of operation of the diver. The helment pressure provided through the breathing gas supply line B is generally equal to the sum of ambient water pressure at the level of diver operation and atmospheric pressure, but such helmet pressure does not exceed ambient water pressure at the base of the helmet, where gas is allowed to escape into the water. Prior to the need for recovery of breathable gas, it was well-known simply to allow the exhausted or exhaled diver helmet gas to flow or escape into the water surrounding the diver. The advent of new technology with respect to the recovery of exhaust gas, such as helium-oxygen mixtures, has brought about the very critical problem of safely transferring the exhaust gas from the diver's helmet H to the exhaust gas recovery system E. Typically, the exhaust gas recovery system E is located at the surface of the water or at a subsurface habitat located above the location of the diver. The location of such exhaust gas recovery systems above the location of the diver has caused particularly dangerous problems with respect to the transfer of exhaust gas from the diver's helmet. For the pressure in the return line at the location of the exhaust gas recovery system E may be substantially lower than the pressure of the gas exhausting from the diver's helmet. This pressure differential between helmet pressure and pressures in the recovery system E, and thus between the two ends of the return line R, if not suitably controlled, may cause a dangerously fast outflow of exhaust gas and thus helmet decompression. The diver gas safety valve D of this invention operates to control the outflow of exhaust gas from the diver's helmet to prevent a dangerous outflow of exhaust gas which might threaten the life of the diver.

In operation, the outflow of exhaust gas is controlled as follows. Exhaust gas leaves the diver's helmet and enters the collapsible tubular element 11 at pressure slightly greater than ambient water pressure. A pressure regulator of a known variety may be mounted between the helmet and the collapsible tubular element. Since the pressure of the outflowing exhaust gas in passageway 11*e* is greater than the ambient water pressure exerted upon the tube from outside thereof, the tube tends to expand to allow the passage of the exhaust gas through the tubular element and thus into the gas return line R. But, whenever the pressure within the bore 11*c* of the collapsible tubular element is less than ambient water pressure, the tube will collapse upon itself and prevent any further gas outflow. Further, the porous sleeve element 25 cooperates with the collapsible tubular element located thereabout to allow and prevent exhaust gas flow from outside the sleeve element 25 into the sleeve element bore 25*a* in response to the pressure differential exerted across the wall of the tubular element 11. Thus, when the pressure of the exhaust gas flowing through the tubular element passageway 11*c* is greater than ambient water pressure, the pressure within the tubular element will cause the tubular element surrounding the porous tube 25 to expand and create an annular passageway of gasflow from passageway 11*c* into the tubular element bore 25*a* and thus into the gas return line R through the adapter bore portion 14*a*. But whenever the pressure within the collapsible tubular portion 11*b* surrounding the tube 25 is less than ambient water pressure, the force of the ambient water pressure compresses the tubular element 11*a* about the tube 25 which prevents the collapsible element 11 from being sucked up into the non-collapsible return line R. Thus, the collapsible tubular element 11 serves to collapse upon itself and to collapse upon the porous tube 25 to prevent any dangerous outflow of gas caused by reduction in pressure within the bore 11*c* of the collapsible tubular element 11.

It may be possible that the pressure differential across the tubular element 11 would be so great that an outflow would be sufficiently strong and expansive to hold the tubular element 11 open and allow a complete escape of air within the helmet prior to actuation or balancing of the interior and exterior forces acting thereon. Such condition may be controlled by the mounting of a pressure regulator or an orifice 30 in adapter bore portion 12*b* to control the volume of flow into the collapsible tubular element 11. Flow control devices other than the orifice 30 may be utilized, such as an actual flow control valve or the like.

Advantages of the diver gas safety valve of this invention are many. First of all, there are no moving parts, such as required in typical flow control valving utilized on such helmets, which must increase the reliability of the device. Secondly, there is no mixing of the exhaust or exhaled gas with water in any form, which occurs in another type of helmet where helmet gasflow is directly exposed to water pressure at all times, this helmet is described in U.S. Pat. No. 4,080,964.

The coiled portion 21 of the collapsible tubular element 11 provides an area of the tube at constant radius through a 360 degree periphery about the approximate central axis of the tubular element, which is defined by end portions 11*a* and 11*b*. Other such configurations may be utilized if desired. As previously mentioned, the hollow, collapsible tubular element 11 may be made of any suitable material which is capable of reacting to a balancing of interior exhaust gas pressures against exterior ambient water pressure and to collapsing and expanding in response thereto. Such a tube may be termed a "flabby" tube. Although the diver gas safety valve V has been illustrated for use in conjunction with a diver's helmet H, it should be understood that such diver gas safety valve may also be connected to other types of underwater habitats, including stationary habitats for controlling the flow of gas from such a habitat to a destination at a lower pressure level.

I claim:

1. In a diving system including a diver's helmet and an exhaust gas recovery system for transferring exhaust gas from such diver's helmet to such exhaust gas recovery system, the improvement comprising a diver gas safety valve adapted for attachment between such diver's helmet and such exhaust gas recovery system to allow for the safe transfer of diver exhaust gas therebetween, comprising:

a hollow, flacid collapsible tubular element having first and second ends a hollow interior portion and an exterior adapted for exposure to ambient water pressure;

attachment means for attaching said first end of said collapsible tubular element to such diver's helmet and said second end thereof to such exhaust gas recovery system; and said collapsible tubular element being adapted to be exposed to such ambient water pressure on the exterior thereof and adapted to be in fluid communication with such exhaust gas in such diver's helmet and such recovery system in the hollow interior thereof, said collapsible tubular element being formed of a flacid material totally collapsible in response to the pressure differential between such ambient water pressure and the pressure of such exhaust gas for expanding to transfer exhaust gas having pressure greater than ambient water pressure surrounding the diver and for collapsing to prevent exhaust gas transfer between such helmet and such exhaust gas recovery system at pressures of such exhaust gas below the ambient water pressure thereby preventing a dangerous outflow of exhaust gas from such diver's helmet.

2. The structure set forth in claim 2, including:

a non-collapsible tubular insert connected with said attachment means and positioned in said hollow interior portion of said collapsible tubular element, said tubular insert being substantially cylindrical in configuration and having one closed end positioned in said collapsible tubular element and a hollow interior in fluid communication with such diving gas recovery system; and said substantially cylindrical tubular insert being porous to allow gas transfer between said hollow interior of said collapsible tubular element and said hollow interior of said non-collapsible tubular insert.

3. The structure set forth in claim 2, including:

said hollow collapsible tubular element including a portion positioned about said tubular insert and being movable between an expanded position providing a flow space between said collapsible tubular element and said insert and a collapsed position in which said portion of said collapsible tubular element interior surrounding said tubular insert engages said tubular insert to prevent the transfer of exhaust gas from said collapsible tubular element to said interior of said non-collapsible tubular insert.

4. The structure set forth in claim 1, including:

said collapsible tubular element including a coiled portion of said tubular element positioned between said attachment means.

5. The structure set forth in claim 1, including:

flow limit means adapted for positioning between such diver's helmet and said collapsible tubular elment interior to limit the flow of exhaust gas from such diver's helmet.

6. The structure set forth in claim 1, including:

a protective casing mounted about said collapsible tubular element and being sufficiently open to allow exposure of said element to ambient water pressure.

* * * * *